US008544311B2

(12) United States Patent
Abe et al.

(10) Patent No.: US 8,544,311 B2
(45) Date of Patent: Oct. 1, 2013

(54) PIPE END SHAPE CORRECTING APPARATUS FOR UOE METAL PIPE

(75) Inventors: Makoto Abe, Osaka (JP); Tomoaki Ikeda, Osaka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/114,090

(22) Filed: May 24, 2011

(65) Prior Publication Data

US 2011/0283765 A1 Nov. 24, 2011

Related U.S. Application Data

(63) Continuation of application No. PCT/JP2009/069422, filed on Nov. 16, 2009.

(30) Foreign Application Priority Data

Nov. 25, 2008 (JP) ..... 2008-299538

(51) Int. Cl.
*B21D 17/02* (2006.01)

(52) U.S. Cl.
USPC ..... 72/415; 72/412; 72/413; 72/414; 72/475

(58) Field of Classification Search
USPC ..... 72/31.02, 31.03, 31.06, 412, 413, 72/414, 415, 474, 475, 48, 51, 350, 353.2, 72/367.1, 368, 347, 348, 421, 477, 125, 157, 72/138, 158, 402, 407, 312, 379.2, 21.1
See application file for complete search history.

(56) References Cited

U.S. PATENT DOCUMENTS

| | | | | | |
|---|---|---|---|---|---|
| 266,653 | A | * | 10/1882 | Spaulding | 72/352 |
| 694,177 | A | * | 2/1902 | Nicklaus | 72/415 |
| 1,821,457 | A | * | 9/1931 | Willis | 72/326 |
| 2,903,929 | A | * | 9/1959 | McVey | 72/399 |

(Continued)

FOREIGN PATENT DOCUMENTS

| | | |
|---|---|---|
| JP | 61-27510 | 2/1966 |
| JP | 52-109472 | 9/1977 |

(Continued)

*Primary Examiner* — Dana Ross
*Assistant Examiner* — Homer Boyer
(74) *Attorney, Agent, or Firm* — Clark & Brody

(57) ABSTRACT

[Problem] There is provided a pipe end shape correcting apparatus capable of improving the roundness without loss of work efficiency and the mechanical damage to a weld bead even in the case where the pipe ends of UOE metal pipes having various outside diameters are worked.

[Solution] In a pipe end shape correcting apparatus for a UOE metal pipe for correcting the roundness of a pipe end portion by applying a pressure to the pipe end portion held between an inner surface-side die and an outer surface-side die, the inner surface-side die having an upper surface having a circular arc-shaped cross section and being fixed to an upper part of a base on the inner surface side, and the outer surface-side die having a lower surface having a circular arc-shaped cross section and being fixed to a lower part of a base on the outer surface side, each of the inner surface-side die and the outer surface-side die is split into a plurality of parts, and is fixed so that a space between the split die parts is located in a respective central portion of the split inner surface-side dies and the split outer surface-side dies.

5 Claims, 3 Drawing Sheets

(56) References Cited

U.S. PATENT DOCUMENTS

| | | | | | |
|---|---|---|---|---|---|
| 4,276,765 | A | * | 7/1981 | Yoneda | 72/402 |
| 4,583,390 | A | * | 4/1986 | Behrens | 72/416 |
| 4,845,817 | A | * | 7/1989 | Wilgus | 29/898.054 |
| 4,989,443 | A | * | 2/1991 | Sawdon | 72/402 |
| 5,092,152 | A | * | 3/1992 | Miller et al. | 72/402 |
| 5,199,170 | A | * | 4/1993 | Mori et al. | 29/898 |
| 5,794,484 | A | * | 8/1998 | Jaddou | 72/414 |
| 5,941,110 | A | * | 8/1999 | Cao et al. | 72/21.4 |
| 6,250,129 | B1 | * | 6/2001 | Bostic | 72/414 |
| 6,718,814 | B2 | * | 4/2004 | Bartrom et al. | 72/402 |

FOREIGN PATENT DOCUMENTS

| | | |
|---|---|---|
| JP | 57-094434 | 6/1982 |
| JP | 03-155416 | 7/1991 |
| JP | 04-26614 | 3/1992 |

* cited by examiner

PIPE END SHAPE CORRECTING APPARATUS FOR UOE METAL PIPE

TECHNICAL FIELD

The present invention relates to a pipe end shape correcting apparatus for improving the roundness of the pipe end of a UOE metal pipe by locally bending the pipe end. More particularly, the present invention relates to a pipe end shape correcting apparatus capable of reducing time and labor required to exchange dies and capable of reducing mechanical damage to a worked portion even in the case where UOE metal pipes having various outside diameters are worked.

BACKGROUND OF THE INVENTION

Generally, UOE metal pipes such as UOE steel pipes for line pipes are laid after being joined to each other by peripheral welding at the laying site. In performing the peripheral welding, the groove faces formed in the pipe end portions of the UOE metal pipes must be butted against each other with high accuracy. If the butting accuracy is inadequate, peripheral welding quality may be degraded and efficiency may be lowered due to the increase in man-hours for correction and, in the worst case, the UOE metal pipes cannot be joined to each other. In order to increase the butting accuracy of groove faces, the roundness in the pipe end portion must be improved, and tight roundness specifications are imposed on the UOE metal pipes.

Usually, the roundness of a UOE metal pipe is improved by expanding the pipe. However, since the principal objective of the pipe expanding process is to wholly correct a difference between the longitudinal diameter and the transverse diameter of the UOE metal pipe, the fulfillment of requirement for local roundness is limited. In order to improve the roundness, a portion where the shape is difficult to secure, such as surroundings of weld bead, must be corrected locally. Especially in the surroundings of weld bead, a remaining chevron-shaped portion of what is called peaking formed at the time of pressing causes the shape of UOE metal pipe to deviate from the ideal truly round shape. For the UOE metal pipe, the peaking formed in the surroundings of weld bead has been a main cause of hindering the improvement in roundness.

Accordingly, a shape correcting apparatus for improving the roundness of the pipe end of a UOE metal pipe for line pipe has conventionally been proposed. For example, in the correcting machine described in Patent Document 1, the roundness of a steel pipe is corrected by using a pair of circular arc-shaped dies (an outer surface-side die and an inner surface-side die). Specifically, a pressure is applied to the steel pipe by the outer surface-side die and the inner surface-side die while the outer surface-side die is in contact with the outer peripheral surface of steel pipe and the inner surface-side die is in contact with the inner peripheral surface of steel pipe, whereby the roundness of steel pipe can be corrected.

PRIOR DOCUMENTS

Patent Documents

[Patent Document 1] JP3-155416A

DISCLOSURE OF THE INVENTION

Problems to be Solved

Unfortunately, in the correcting machine described in Patent Document 1, the dies must be replaced for a different size of steel pipe, which decreases the work efficiency. Also, dies having different sizes must be prepared for each size of steel pipe, so that the cost of manufacturing the dies increases. Also, since the weld bead is slightly raised as compared with other portions, the weld zone comes into contact with the die when the roundness is corrected by the above-described correcting machine. Thereby, a flaw may be induced in the weld bead.

The present invention has been made to solve the problems with the prior art, and accordingly an objective thereof is to provide a pipe end shape correcting apparatus capable of improving the roundness without loss of work efficiency and the mechanical damage to a weld bead even in the case where the pipe ends of UOE metal pipes having various outside diameters are worked.

Means for Solving the Problem

The present inventors conducted various studies to provide a pipe end shape correcting apparatus in which a die need not be exchanged, and a flaw does not occur in the weld bead even in the case where the pipe ends of UOE metal pipes having various outside diameters are worked. As the result, the following findings of items (a) to (e) were obtained.

(a) In order to correct the roundness of the pipe end portion of a UOE metal pipe, the pipe end portion has only to be held between an inner surface-side die, which has an upper surface having a circular arc-shaped cross section and is fixed to the upper part of a base on the inner surface side, and an outer surface-side die, which has a lower surface having a circular arc-shaped cross section and is fixed to the lower part of a base on the outer surface side, and a pressure has only to be applied. At this time, concerning these dies for working the pipe end of the UOE metal pipe, parts of the dies have only to be present in a portion corresponding to the worked portion of the pipe end of the UOE metal pipe. In other words, both of the inner surface-side die and the outer surface-side die need not to be continuous dies corresponding to, and flush with, the inner surface and the outer surface, respectively, of the pipe end of the UOE metal pipe. Therefore, for each of the inner surface-side die having the upper surface having a circular arc-shaped cross section and the outer surface-side die having the lower surface having a circular arc-shaped cross section, a die split into a plurality of parts can be used to work the pipe end of the UOE metal pipe.

(b) Thus, both of the inner surface-side die and the outer surface-side die can be made split-type dies. Since parts of the dies need not be present in a portion not corresponding to the worked portion of the pipe end of the UOE metal pipe, by widening or narrowing the space between the split die parts, the whole of the split-type dies can accommodate to various pipe diameters. Therefore, if the pipe end of the UOE metal pipe is worked by using the dies split into the plurality of parts as described above, both of the inner surface-side die and the outer surface-side die can accommodate a wide change of pipe diameter merely by one kind of dies. Since the width of the space between the split die parts can be changed corresponding to the pipe end diameter of the UOE metal pipe, the dies need not be replaced for each size of metal pipe, and the man-hours for die replacement associated with the variation of pipe diameter can be reduced. Therefore, the work efficiency is improved, and the die manufacturing cost is reduced.

(c) Also, when the pipe end of the UOE metal pipe is worked, in order to prevent a flaw from occurring in the weld bead on the inner and outer surfaces of the pipe end, the dies on the inner and outer surface sides have only to be prevented from coming into contact with the weld bead. That is, the working has only to be performed in the state in which the weld bead is located in the space portion between the split die parts. For this purpose, the split inner surface-side dies and outer surface-side dies have only to be fixed to the upper part of the base on the inner surface side and the lower part of the base on the outer surface side, respectively, so that the space between the split die parts is located in the central portions of the split inner surface-side dies and outer surface-side dies. At this time, the width of the space between the split die parts can be changed corresponding to the width of the weld bead of the UOE metal pipe.

The width of the space between the split die parts should be about 3 to 7 cm corresponding to the width of weld bead. The width of the space in the inner surface-side die is preferably narrower than the width of the space in the outer surface-side die, and the difference between these widths is further preferably about 3 cm.

If a spacer is used to set the space widths between the split die parts in the inner surface-side die and between the split die parts in the outer surface-side die, the adjustment of the space widths can be made easily.

(d) The number of splits of die is not subject to any special restriction. However, from the viewpoint of ease of handling, both of the inner surface-side die and the outer surface-side die should be split into two.

(e) In order to hold the pipe end portion between the inner surface-side die, which has the upper surface having a circular arc-shaped cross section and is fixed to the upper part of the base on the inner surface side, and the outer surface-side die, which has the lower surface having a circular arc-shaped cross section and is fixed to the lower part of the base on the outer surface side, and to apply a pressure, for example, either or both of the raising process of the base on the inner surface side and the lowering process of the base on the outer surface side have only to be adopted. Also, in order to move the bases on the inner surface side and the outer surface side up and down, for example, a hydraulic cylinder has only to be connected to the base on the inner surface side and/or on the outer surface side.

The present invention was made based on the above-described findings, and the gist thereof is the pipe end shape correcting apparatuses for a UOE metal pipe of the following items (1) to (6).

(1) A pipe end shape correcting apparatus for a UOE metal pipe for correcting the roundness of a pipe end portion by applying a pressure to the pipe end portion held between an inner surface-side die and an outer surface-side die, the inner surface-side die having an upper surface having a circular arc-shaped cross section and being fixed to an upper part of a base on the inner surface side, and the outer surface-side die having a lower surface having a circular arc-shaped cross section and being fixed to a lower part of a base on the outer surface side, wherein each of the inner surface-side die and the outer surface-side die is split into a plurality of parts, and is fixed so that a space between the split die parts is located in a respective central portion of the split inner surface-side dies and the split outer surface-side dies.

(2) The pipe end shape correcting apparatus for a UOE metal pipe according to the item (1), wherein the pipe end portion is subjected to pressure by rising the base on the inner surface side and/or lowering the base on the outer surface side.

(3) The pipe end shape correcting apparatus for a UOE metal pipe according to the item (1) or (2), wherein the inner surface-side die and/or the outer surface-side die are configured so that the width of the space between the split die parts can be changed according to the pipe end diameter of the UOE metal pipe and/or the width of a weld bead.

(4) The pipe end shape correcting apparatus for a UOE metal pipe according to any one of the items (1) to (3), wherein the width of the space between the split die parts in the inner surface-side die is set to at most the width of the space between the split die parts in the outer surface-side die.

(5) The pipe end shape correcting apparatus for a UOE metal pipe according to any one of the items (1) to (4), wherein a spacer is used to set the space width between the split die parts in the inner surface-side die and/or between the split die parts in the outer surface-side die.

(6) The pipe end shape correcting apparatus for a UOE metal pipe according to any one of the items (1) to (5), wherein the inner surface-side die and/or the outer surface-side die are split into two parts.

Advantages of the Invention

The pipe end shape correcting apparatus in accordance with the present invention can improve the roundness without loss of work efficiency and the mechanical damage to a weld bead even in the case where the pipe ends of UOE metal pipes having various outside diameters are worked.

EMBODIMENT TO EXECUTE THE INVENTION

A pipe end shape correcting apparatus in accordance with an embodiment of the present invention will now be described with reference to the accompanying drawings.

1. Configuration of Pipe End Shape Correcting Apparatus

Figure 1:
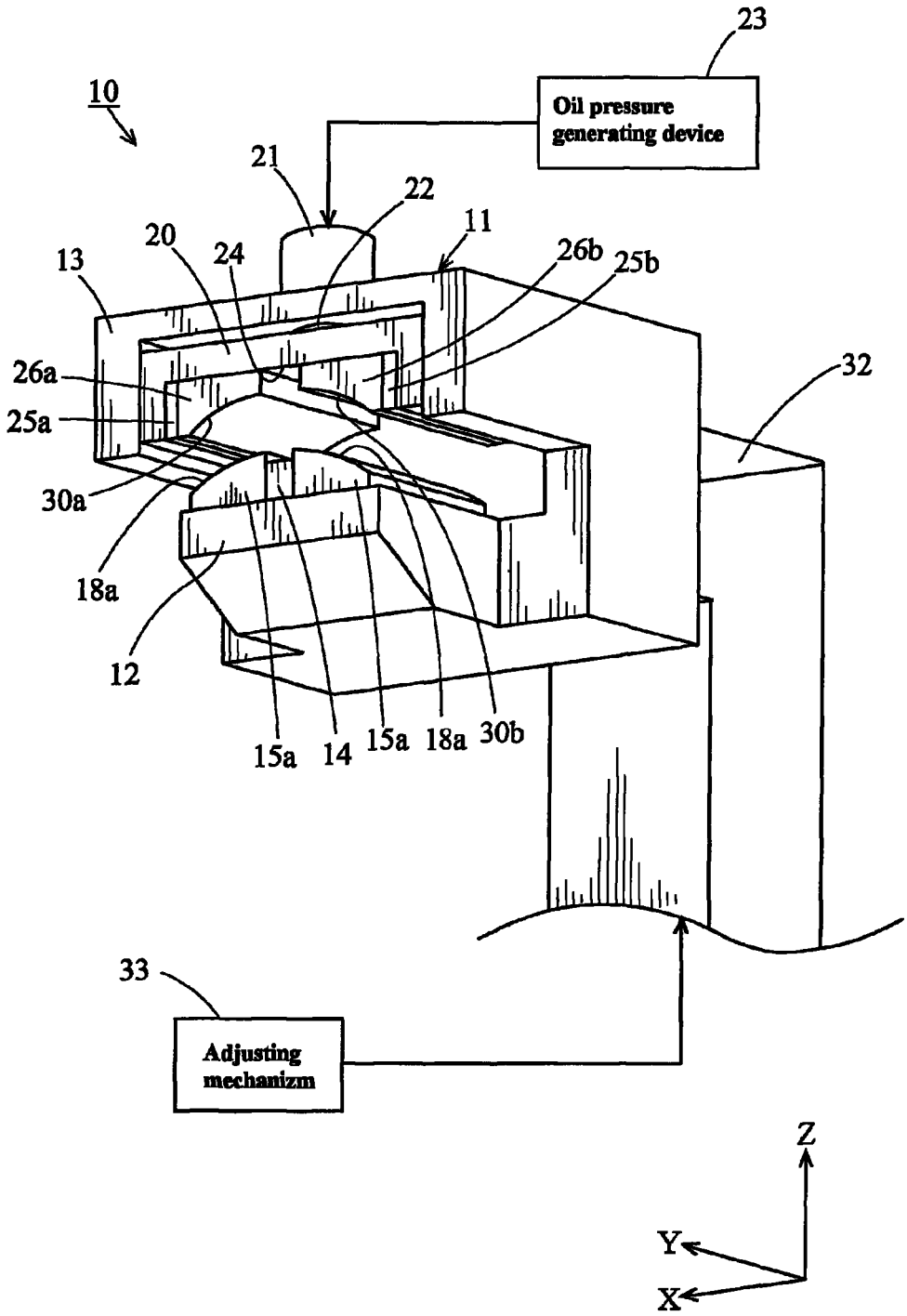
FIG. 1 is a perspective view of a pipe end shape correcting apparatus in accordance with one embodiment of the present invention, as viewed from the slantwise lower side.
Figure 2:
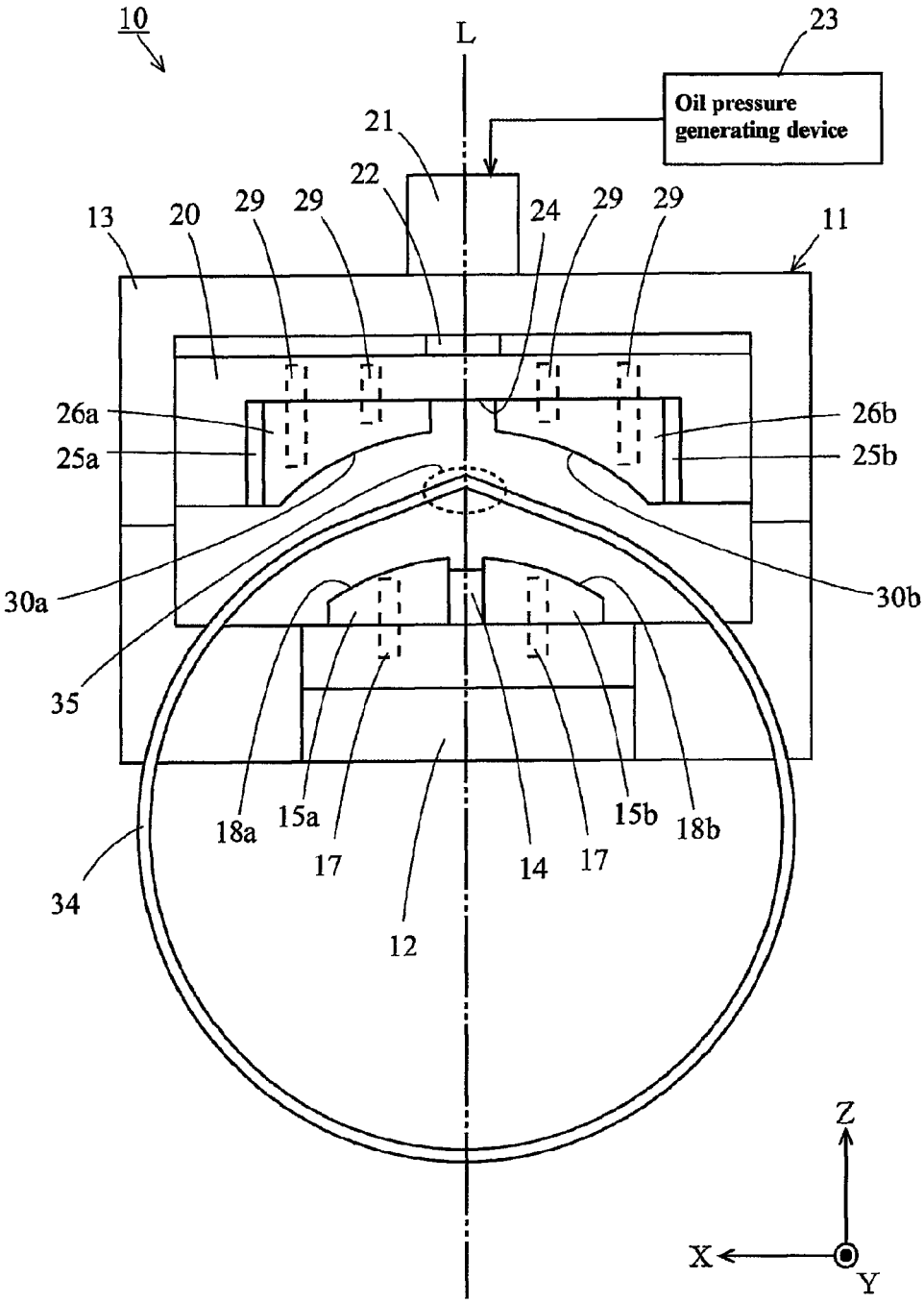
FIG. 2 is a front view of the pipe end shape correcting apparatus shown in FIG. 1.
Figure 3:
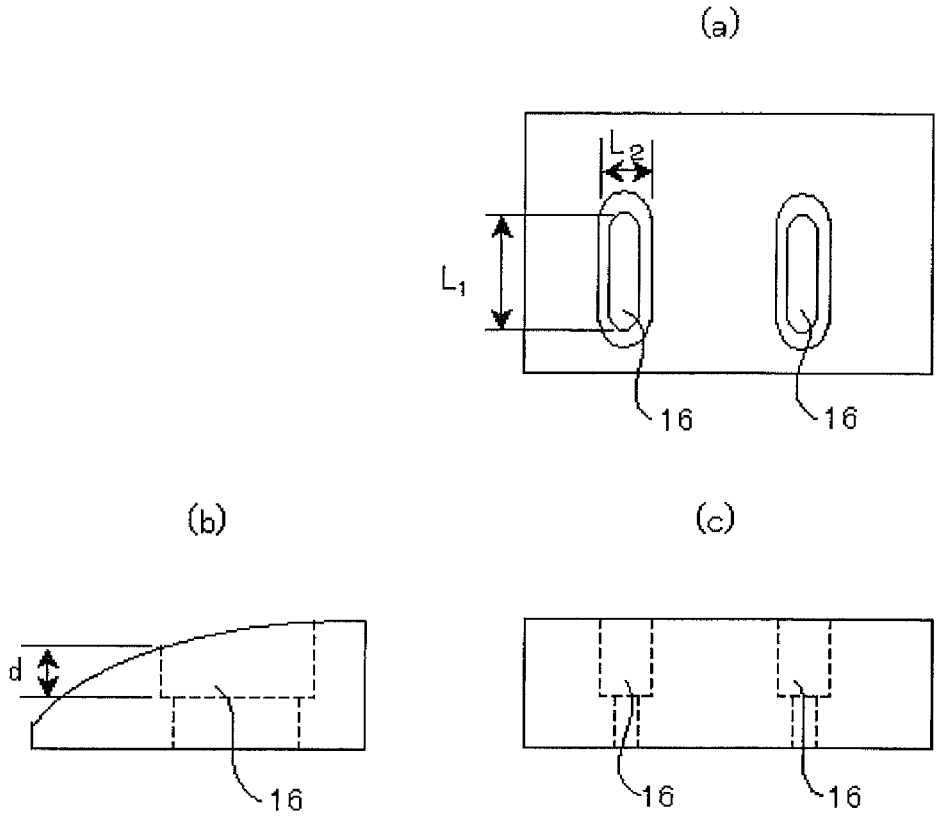
FIGS. 3(*a*), 3(*b*) and 3(*c*) are plan, front and side views showing one example of bolt holes for fixing an inner surface-side die onto a base.

FIG. 1 is a perspective view of a pipe end shape correcting apparatus in accordance with one embodiment of the present invention, as viewed from the slantwise lower side, FIG. 2 is a front view of the pipe end shape correcting apparatus shown in FIG. 1, and FIGS. 3(*a*), 3(*b*) and 3(*c*) are plan, front and side views showing one example of bolt holes for fixing an inner surface-side die onto a base.

In FIGS. 1 and 2, for ease of explanation, three directions intersecting at right angles with each other are defined as the X direction, the Y direction (pipe longitudinal direction), and the Z direction. Also, the direction indicated by an arrow is referred to as the + direction, and the direction reverse to the + direction is referred to as the − direction. The +Y direction side is referred to as the front, and the +Z direction side is referred to as the upside. The Z direction indicates the vertical direction. Further, in FIG. 1, only the YZ plane is partially hatched.

As shown in FIGS. 1 and 2, a pipe end shape correcting apparatus 10 in accordance with this embodiment (hereinafter, referred simply to as a correcting apparatus 10) has a box-shaped frame 11 the front of which is open. In the lower part of the frame 11, an inner surface-side base 12 is formed so as to project toward the front, and in the upper part of the frame 11, a ceiling part 13 having an inverted concave shaped cross section is formed so as to cover the upside of the inner surface-side base 12.

In the central portion of the inner surface-side base 12, a plate-shaped spacer 14 is provided. To the upper part of the inner surface-side base 12, long inner surface-side dies 15*a* and 15*b* are fixed with the spacer 14 located in the central portion being held there between. The inner surface-side dies 15*a* and 15*b* have upper surfaces 18*a* and 18*b* each having a circular arc-shaped cross section, respectively. The cross-sectional shape (the shape of the cross section parallel to the XZ plane) of the inner surface-side die 15*a* corresponds to an inverted cross-sectional shape of the inner surface-side die 15*b*.

The inner surface-side dies 15*a* and 15*b* can be fixed to any positions on the inner surface-side base 12. In this embodiment, the fixing positions of the inner surface-side dies 15*a* and 15*b* are determined by using the spacer 14, and the inner surface-side dies 15*a* and 15*b* are fixed to the inner surface-side base 12 by a plurality of bolts 17 (FIG. 2). As shown in FIG. 3, in each of the inner surface-side dies 15*a* and 15*b*, stepped elliptical holes 16 are formed so that the bolts can be inserted therethrough at any positions. The bolt holes in the base 12 are provided at positions that facilitate the movement of the inner surface-side dies 15*a* and 15*b* without any trouble when they are moved. Therefore, when being fixed to the base 12, the inner surface-side dies 15*a* and 15*b* can be fixed at any positions by using the bolts 17 with washers or clip plates. That is, the length $L_1$ of an elliptical lower-step hole is the length of the movable range of the inner surface-side die, and the width $L_2$ of an elliptical upper-step hole is the width accommodating a wrench for tightening the bolts. The depth d of the elliptical upper-step hole is larger than the height of the bolt head.

The spacer 14 is used to position the inner surface-side dies 15*a* and 15*b*. As the spacer 14, for example, a plate-shaped spacer made of wood, resin, or metal can be used. The spacer 14 may be removed after the inner surface-side dies 15*a* and 15*b* have been fixed to the inner surface-side base 12. However, the spacer 14 is preferably not removed to make the fixing positions of dies invariable even at the time of pressure application.

On the inner surfaces of the ceiling part 13, an outer surface-side base 20 having an inverted concave shaped cross section is provided so as to be movable up and down. Also, to the central portion of the ceiling 13, a hydraulic cylinder 21 is fixed. The lower end of a piston 22 of the hydraulic cylinder 21 is attached to the outer surface-side base 20. Also, the hydraulic cylinder 21 is connected with an oil pressure generating device 23. In this embodiment, the oil pressure in the hydraulic cylinder 21 is regulated by the oil pressure generating device 23. Thereby, the displacement of the piston 22 is adjusted, and the position in the vertical direction of the outer surface-side base 20 is adjusted.

On one side surface of an inverted concave shaped region 24 (hereinafter, referred to as a concave part 24) of the outer surface-side base 20, an outer surface-side die 26*a* is provided via a plate-shaped spacer 25*a*, and on the other side surface thereof, an outer surface-side die 26*b* is provided via a plate-shaped spacer 25*b*. The outer surface-side dies 26*a* and 26*b* have lower surfaces 30*a* and 30*b* each having a circular arc-shaped cross section, respectively. The cross-sectional shape (the shape of the cross section parallel to the XZ plane) of the outer surface-side die 26*a* corresponds to an inverted cross-sectional shape of the outer surface-side die 26*b*.

The outer surface-side dies 26*a* and 26*b* can be fixed to any positions in the concave part 24. In this embodiment, the fixing positions of the outer surface-side dies 26*a* and 26*b* are determined by using the spacers 25*a* and 25*b*, respectively, and the outer surface-side dies 26*a* and 26*b* are fixed to the lower part of the outer surface-side base 20 by a plurality of bolts 29 (FIG. 2). As in the inner surface-side dies 15*a* and 15*b*, in the outer surface-side dies 26*a* and 26*b*, stepped elliptical holes are formed. The bolt holes in the base 20 are provided at positions that facilitate the movement of the outer surface-side dies 26*a* and 26*b* without any trouble when they are moved. Therefore, the bolts can be inserted at any positions, and thereby the outer surface-side dies 26*a* and 26*b* can be fixed at any positions.

The spacers 25*a* and 25*b* are used to position the outer surface-side dies 26*a* and 26*b* as described above. As the spacers 25*a* and 25*b*, for example, plate-shaped spacers made of wood, resin, or metal can be used. The spacers 25*a* and 25*b* may be removed after the outer surface-side dies 26*a* and 26*b* have been fixed to the outer surface-side base 20. However, the spacers 25*a* and 25*b* are preferably not removed to make the fixing positions of dies invariable even at the time of pressure application. The sizes of the spacers 25*a* and 25*b* are set so that a space is formed between the outer surface-side die 26*a* and the outer surface-side die 26*b*. In this embodiment, as shown in FIG. 2, the middle point of the outer surface-side die 26*a* and the outer surface-side die 26*b* is located on the centerline L of the spacer 14. The centerline L is a straight line extending in the vertical direction.

As shown in FIG. 1, to the back surface side of the frame 11, an inverted L-shaped arm 32 is fixed. The arm 32 is provided with an adjusting mechanism 33 for moving the arm 32 up and down. The adjusting mechanism 33 can be configured by using, for example, a pressure pump or an electric motor; however, it may be of a manually-operated type.

2. Correcting Method

Next, a method of correcting the roundness of a UOE metal pipe using the above-described correcting apparatus 10 is explained.

As shown in FIG. 2, first, the pipe end portion of a UOE metal pipe 34 is inserted between the inner surface-side dies 15*a* and 15*b* and the outer surface-side dies 26*a* and 26*b* so that a weld bead 35 is located on the centerline L. In this state, the hydraulic cylinder 21 is driven by the oil pressure generating device 23 to move the outer surface-side base 20 downward. Thereby, the surrounding portion of the weld bead 35 is pressed against the upper surfaces 18*a* and 18*b* of the inner surface-side dies 15*a* and 15*b* by the lower surfaces 30*a* and 30*b* of the outer surface-side dies 26*a* and 26*b*, and is subjected to pressure. As the result, the roundness of a chevron-shaped portion (peaking) around the weld bead 35 is corrected.

In this embodiment, the fixing positions of the inner surface-side dies 15*a* and 15*b* and the outer surface-side dies 26*a* and 26*b* can be adjusted according to the pipe diameter of the UOE metal pipe 34. Therefore, the correcting apparatus 10 in accordance with this embodiment can be used for the UOE metal pipes 34 having various pipe diameters. Specifically, when the roundness of the UOE metal pipe 34 having a large pipe diameter is to be corrected, the fixing positions of the inner surface-side dies 15*a* and 15*b* and the outer surface-side dies 26*a* and 26*b* are moved so as to be separate from the centerline L. On the other hand, when the roundness of the UOE metal pipe 34 having a small pipe diameter is to be corrected, the fixing positions of the inner surface-side dies

15*a* and 15*b* and the outer surface-side dies 26*a* and 26*b* are moved so as to be close to the centerline L.

Also, in this embodiment, since the arm 32 can be moved up and down by the adjusting mechanism 33, the frame 11 can be moved to a proper position depending on the pipe diameter of the UOE metal pipe 34.

In this embodiment, by preparing the spacers 14, 25*a* and 25*b* each having various sizes in advance, the fixing positions of the inner surface-side dies 15*a* and 15*b* and the outer surface-side dies 26*a* and 26*b* can be determined quickly.

At the time of correction, the inner surface-side dies 15*a* and 15*b* are subjected to a reaction force to the inside, and the outer surface-side dies 26*a* and 26*b* are subjected to a reaction force to the outside. However, since the inner surface-side dies 15*a* and 15*b* are used with the spacer 14 being held therebetween, and the outer surface-side dies 26*a* and 26*b* are used with the spacers 25*a* and 25*b* being held between the dies 26*a* and 26*b* and the outer surface-side base 20, the reaction forces are received, and the dies can be held at proper positions.

3. Preferred Dimensions and Materials of Components of Correcting Apparatus 10

From the viewpoint of practical use, it is enough to correct the roundness over the range of about 100 mm to 200 mm in the width direction (the X direction in FIG. 1) of the pipe end with the centerline L (FIG. 2) being the center and over the range of about 200 min from the pipe end in the longitudinal direction (the Y direction in FIG. 1). Therefore, it is preferable that the inner surface-side dies 15*a* and 15*b* and the outer surface-side dies 26*a* and 26*b* each have a width of 100 to 200 mm and a length of about 200 mm±20 mm. If the dies each have these dimensions, the correcting apparatus 10 can be used for UOE metal pipes having almost all diameters.

The height (the length in the Z direction) of each of the outer surface-side dies 26*a* and 26*b* is preferably not smaller than 40 mm in the thin portion thereof considering the strength at the time when the bolts 29 are screwed into the inner surface-side base 12. On the other hand, the height of each of the inner surface-side dies 15*a* and 15*b* is preferably not smaller than 40 mm in the thin portion thereof for the same reason, and is preferably not larger than 80 mm even in the thick portion thereof so that the die enters a small-diameter UOE metal pipe.

As the material for the inner surface-side dies 15*a* and 15*b* and the outer surface-side dies 26*a* and 26*b*, a tool steel (for example, SKD61-) is preferably used considering the wear resistance. The hardness of the inner surface-side dies 15*a* and 15*b* and the outer surface-side dies 26*a* and 26*b* is preferably not less than 40 Shore hardness (Hs).

The lengths in the width direction (the X direction) of the space between the inner surface-side dies 15*a* and 15*b* and the space between the outer surface-side dies 26*a* and 26*b* are preferably adjusted according to the width of the weld bead 35 and the diameter of the metal pipe to be corrected. The lengths are adjusted so that the dies are placed in a proper contacting state depending on the diameter of the metal pipe while a length of about 3 cm to 7 cm is secured depending on the bead width to protect the weld bead. At this time, the radius of curvature of the inner surface-side dies 15*a* and 15*b* and the radius of curvature of the outer surface-side dies 26*a* and 26*b* may not necessarily agree with the inside diameter and outside diameter of metal pipe, respectively, and it is only necessary to be able to suppress the peaking within an allowable range. In this embodiment, the pipe end shapes of pipes of a wide diameter range can be corrected by using one kind of dies.

The inner surface-side dies 15*a* and 15*b* may be manufactured, for example, by splitting one die having an upper surface of a circular arc shape in cross section into two equal parts. In this case, the inner surface-side dies 15*a* and 15*b* can be manufactured easily with high accuracy. Therefore, the manufacturing cost of the inner surface-side dies 15*a* and 15*b* can be reduced, and the accuracy of roundness correction can be improved. Similarly, the outer surface-side dies 26*a* and 26*b* may be manufactured by splitting one die having a lower surface of a circular arc shape in cross section into two equal parts.

4. Advantages of this Embodiment

As described above, in the correcting apparatus 10 in accordance with this embodiment, spaces are formed between the inner surface-side dies 15*a* and 15*b* and between the outer surface-side dies 26*a* and 26*b*, and the roundness of the UOE metal pipe 34 is corrected while the weld bead 35 is positioned between these two spaces. Therefore, the contact of the inner surface-side dies 15*a* and 15*b* with the weld bead 35 and the contact of the outer surface-side dies 26*a* and 26*b* with the weld bead 35 can be avoided. Thereby, the mechanical damage to the weld bead 35 and the occurrence of a flaw in the weld bead 35 can be prevented.

Also, in this embodiment, the inner surface-side dies 15*a* and 15*b* can be fixed to any positions on the inner surface-side base 12, and the outer surface-side dies 26*a* and 26*b* can be fixed to any positions in the concave part 24. Therefore, the fixing positions of the inner surface-side dies 15*a* and 15*b* and the outer surface-side dies 26*a* and 26*b* can be adjusted according to the pipe diameter of the UOE metal pipe 34, so that the roundness of the UOE metal pipe 34 can be corrected without replacing the inner surface-side dies 15*a* and 15*b* and the outer surface-side dies 26*a* and 26*b*. In this case, since a large number of inner surface-side dies 15*a* and 15*b* and outer surface-side dies 26*a* and 26*b* need not be manufactured, the cost can be reduced. Also, since the inner surface-side dies 15*a* and 15*b* and the outer surface-side dies 26*a* and 26*b* need not be replaced, the work efficiency is improved. By preparing the spacers 14, 25*a* and 25*b* each having various sizes in advance, the fixing positions of the dies 15*a*, 15*b*, 26*a* and 26*b* and the spaces between the dies can be adjusted quickly. Needless to say, the spaces may be adjusted by using a plurality of lapped spacers.

5. Modifications

In the above-described embodiment, the inner surface-side base 12 is formed integrally with the frame 11, and the outer surface-side base 20 is provided so as to be movable up and down with respect to the frame 11. However, the configuration of the correcting apparatus 10 is not limited to the above-described one as long as the configuration is such that the UOE metal pipe 34 can be subjected to pressure by the inner surface-side dies 15*a* and 15*b* and/or the outer surface-side dies 26*a* and 26*b*. For example, the configuration may be such that the outer surface-side base 20 is fixed to the frame 11 and the inner surface-side base 12 is provided so as to be movable up and down with respect to the frame 11. In this case, by raising the inner surface-side base 12 by the hydraulic cylinder 21 (or a hydraulic jack), a pressure can be applied to the pipe end portion of the UOE metal pipe 34 held between the inner surface-side dies 15*a* and 15*b* and the outer surface-side dies 26*a* and 26*b*. Thereby, the roundness of the pipe end portion of the UOE metal pipe 34 can be corrected.

Also, in the above-described embodiment, the two inner surface-side dies 15*a* and 15*b* and the two outer surface-side dies 26*a* and 26*b* are provided. However, three or more inner surface-side dies and/or three or more outer surface-side dies may be provided.

Examples

Table 1 gives the results of correction of the pipe end of UOE metal pipe made by actually using the correcting apparatus 10 explained with reference to FIGS. 1 and 2. As shown in Table 1, five kinds (examples 1 to 5) of UOE metal pipes having different outside diameters and wall thicknesses were prepared. For each of these UOE metal pipes, the roundness of the pipe end portion of the UOE metal pipe was corrected by using the inner surface-side dies 15*a* and 15*b* and the outer surface-side dies 26*a* and 26*b* having the sizes shown in Table 2. The distance between the inner surface-side dies 15*a* and 15*b* and the distance between outer surface-side dies 26*a* and 26*b* were set as shown in Table 1. Also, the target value of peaking amount (shift from the complete round) after roundness correction was set at 1.5 mm.

[Table 1]

TABLE 1

| | Pipe size (mm) | | Used dies type | | Distance between dies (mm) | | Peaking amount (mm) | | Damage |
|---|---|---|---|---|---|---|---|---|---|
| Example | Outside diamter | Wall thickness | Inner dies | Outer dies | Inner dies | Outer dies | Before correcting | After correcting | of weld zone |
| 1 | 508 | 19 | (A) | (a) | 30 | 30 | 2.1 | 0.8 | no |
| 2 | 762 | 19 | (A) | (a) | 40 | 70 | 1.9 | 0.3 | no |
| 3 | 1016 | 22 | (B) | (b) | 30 | 30 | 2.2 | 1.2 | no |
| 4 | 1270 | 22 | (B) | (b) | 40 | 60 | 2.3 | 0.5 | no |
| 5 | 1524 | 19 | (C) | (c) | 40 | 60 | 1.8 | 0.3 | no |

[Table 2]

TABLE 2

| | Dies type | Radius of die(*) (mm) | Height(**) (mm) | Width (mm) | Length (mm) |
|---|---|---|---|---|---|
| Inner | (A) | 254 | 80 | 120 | 200 |
| | (B) | 508 | 50 | 150 | 200 |
| | (C) | 635 | 40 | 180 | 200 |
| Outer | (a) | 317 | 100 | 120 | 200 |
| | (b) | 571 | 50 | 150 | 200 |
| | (c) | 698.5 | 40 | 180 | 200 |

(*)Radius of die means a radius of carvature to contact an outer surface of pipe.
(**)Height means the one of the summit of die on the base.

To demonstrate that the UOE metal pipes having a plurality of sizes can be corrected by only one kind of dies, in examples 1 and 2 and examples 3 and 4, test was conducted by using the same dies (dies (A) and (a) and dies (B) and (b), respectively) and by changing the die-to-die distance only. As the result, in all of examples 1 to 4, the roundness could be improved to not more than 1.5 mm, which was the target value.

From the above-described result, it was revealed that even if the diameter of UOE metal pipe changes in the range of outside diameter of 508 mm (20 inches) to 1524 mm (60 inches), the dies need not be exchanged successively, and the desired roundness can be obtained by only three kinds of dies of dies (A) and (a), dies (B) and (b), and dies (C) and (c).

Further, the weld bead 35 (refer to FIG. 2) was visually inspected after correction for damages. As shown in Table 1, in all examples, no damage was found. Thus, it was also confirmed that in terms of surface quality of UOE metal pipe, the correcting apparatus 10 in accordance with this embodiment is an excellent correcting apparatus.

INDUSTRIAL APPLICABILITY

The present invention can provide a pipe end shape correcting apparatus capable of improving the roundness without loss of work efficiency and the mechanical damage to a weld bead even in the case where the pipe ends of UOE metal pipes having various outside diameters are worked.

| [Explanation of referred symbols] | |
|---|---|
| 10 | correcting apparatus |
| 11 | frame |
| 12 | inner surface-side base |
| 13 | ceiling part |
| 14 | spacer |
| 15a, 15b | inner surface-side die |
| 16 | hole |
| 17 | bolt |
| 18a, 18b | upper surface |

-continued

| [Explanation of referred symbols] | |
|---|---|
| 20 | outer surface-side base |
| 21 | hydraulic cylinder |
| 22 | piston |
| 23 | oil pressure generating device |
| 24 | concave part |
| 25a, 25b | spacer |
| 26a, 26b | outer surface-side die |
| 29 | bolt |
| 30a, 30b | lower surface |
| 32 | arm |
| 33 | adjusting mechanism |
| 34 | UOE metal pipe |
| 35 | weld bead |

The invention claimed is:

1. A pipe end shape correcting apparatus for a UOE metal pipe for correcting the roundness of a pipe end portion by applying a pressure to the pipe end portion held between an inner surface-side die and an outer surface-side die, the inner surface-side die having an upper surface having a circular arc-shaped cross section and being fixed to an upper part of a base on the inner surface side, and the outer surface-side die having a lower surface having a circular arc-shaped cross section and being fixed to a lower part of a base on the outer surface side, wherein each of the inner surface-side die and the outer surface-side die is split into a plurality of parts at the respective cross section, and is fixed so that a space between the split die parts is located in a respective central portion of the split inner surface-side dies and the split outer surface-side dies in order to prevent both of the said split inner surface-side dies and the said split outer surface-side dies from coming into contact with the said weld bead when the pipe end of the UOE metal pipe is worked, and wherein at least one of the inner surface-side die and the outer surface-side die is configured so that width of the space between the split die parts can be changed according to at least one of pipe end diameter of the UOE metal pipe and width of a weld bead.

2. The pipe end shape correcting apparatus for a UOE metal pipe according to claim 1, wherein the pipe end portion is subjected to pressure by at least one of rising the base on the inner surface side and lowering the base on the outer surface side.

3. The pipe end shape correcting apparatus for a UOE metal pipe according to claim 1, wherein the width of the space between the split die parts in the inner surface-side die is set to at most the width of the space between the split die parts in the outer surface-side die.

4. The pipe end shape correcting apparatus for a UOE metal pipe according to claim 1, wherein a spacer is used to set the spacer width at least one of between the split die parts in the inner surface-side die and between the split die parts in the outer surface-side die.

5. The pipe end shape correcting apparatus for a UOE metal pipe according to claim 1, wherein at least one of the inner surface-side die and the outer surface-side die is split into two parts.

* * * * *